United States Patent [19]

Montgon

[11] Patent Number: 4,867,321

[45] Date of Patent: Sep. 19, 1989

[54] VARIABLE REACH CRANE JIB WITH AUTOMATIC BALANCING DEVICE

[75] Inventor: Serge Montgon, Saint Esteve, France

[73] Assignee: Sociét',acu/3/ Montgon Systémes, Ste. Esteve, France

[21] Appl. No.: 170,599

[22] Filed: Mar. 16, 1988

Related U.S. Application Data

[63] Continuation of Ser. No. 554,642, Nov. 23, 1983, abandoned.

[30] Foreign Application Priority Data

Nov. 26, 1982 [FR] France ..... 82 19842

[51] Int. Cl.[4] ..... B66C 23/76

[52] U.S. Cl. ..... 212/196; 414/708; 212/195

[58] Field of Search ..... 212/195, 196, 197; 414/708, 719

[56] References Cited

U.S. PATENT DOCUMENTS

| | | | |
|---|---|---|---|
| 3,462,103 | 8/1969 | Strom | 182/2 |
| 3,726,416 | 4/1973 | Pottorff et al. | 212/178 |
| 3,734,326 | 5/1973 | Esser | 414/719 |
| 3,924,753 | 12/1975 | Lamer et al. | 212/196 |
| 3,938,669 | 2/1976 | Vinton | 414/719 |
| 4,491,227 | 1/1985 | Buzzichelli et al. | 212/196 |

FOREIGN PATENT DOCUMENTS

| | | | |
|---|---|---|---|
| 33060 | 8/1981 | European Pat. Off. | 212/196 |
| 2113851 | 6/1972 | France . | |
| 596613 | 8/1959 | Italy | 212/195 |
| 589204 | 1/1978 | U.S.S.R. | 212/195 |
| 1110454 | 4/1968 | United Kingdom | 212/197 |

*Primary Examiner*—Sherman D. Basinger
*Assistant Examiner*—Thomas J. Brahan
*Attorney, Agent, or Firm*—Bert J. Lewen; Henry Sternberg

[57] ABSTRACT

The invention provides a system for automatically balancing the jib of cranes of the type with articulated arms or telescopic arms depending on the variation of the reach of this jib.

The annular section chambers of the hydraulic cylinder controlling the auxiliary arm of the crane and of the hydraulic cylinder controlling the pivoting arm carrying the counterweight are connected in series by a duct. The full section chambers of the hydraulic cylinders are connected selectively, by actuation of a valve, either to the pressure line or to the return line. In the right-hand position of the valve, the counterweight is pivoted and the arm is raised simultaneously, whereas in the opposite position of the valve the arm is lowered and the counterweight is raised.

6 Claims, 2 Drawing Sheets

VARIABLE REACH CRANE JIB WITH AUTOMATIC BALANCING DEVICE

This application is a continuation of application Ser. No. 554,642, filed Nov. 23, 1983, now abandoned.

BACKGROUND OF THE INVENTION

1. Field of the Invention

The invention relates to apparatus of the crane type with a jib having articulated or telescopic arms for lifting or handling loads with a grab, winch-hook or hook. It relates more particularly to a device for automatically balancing the jib of such cranes depending on the variation of the radius or reach of this jib.

2. Description of the Prior Art

In known apparatus of this kind, the crane jib is generally articulated to the turret , without balancing, the counterweight itself being fixed to the turret. In this case, the counterweight in fact only serves for reducing the reversing moment but by a fixed value and without compensation as a function of the reach of the jib. Moreover, actuation cylinders for lifting the main arm or the auxiliary arm must lift at one and the same time the load, the jib and the member grasping the load.

SUMMARY OF THE INVENTION

The aim of the invention is to overcome the above-mentioned disadvantages of known apparatus and, to this end, it proposes equipping the crane jib with a device for automatically balancing this jib depending on the variation of its reach.

According to the invention, the main jib arm which is extended at one end by an auxiliary arm movable under the action of a control means is connected at its other end to a counterweight which is also movable under the action of a control means, and a connection is provided between the control means of the auxiliary arm and of the counterweight for automatically ensuring movement of the counterweight proportional to the movement of the auxiliary arm thus achieving at will, whatever the position of the auxiliary arm, total or partial balancing of the jib.

The device of the invention in addition allows the powers of the driving and driven members required for moving the load to be considerably reduced and, so the energy consumption to be reduced.

In a preferred embodiment of the invention, the means for controlling the auxiliary arm and the counterweight are each formed by a hydraulic acting cylinder, one chamber of one of these two cylinders being connected in series to a chamber of the other cylinder whereas a valve allows the other chamber of the hydraulic cylinder controlling the auxiliary arm to be supplied with pressurized fluid and the other chamber of the hydraulic cylinder controlling the counterweight to be placed in communication with the fluid reservoir, or conversely, the other chamber of the hydraulic cylinder controlling the counterweight to be connected to the pressurized fluid supply and said other chamber of the hydraulic cylinder controlling the auxiliary arm to be placed in communication with the reservoir. Since the value of the counterweight is calculated as a function of the proper weight of the parts of the jib (including the grasping means such as grab or sheave-block that it supports) and as a function of the lever arms, the synchronized movements of the auxiliary arm and of the counterweight (by supplying the hydraulic cylinder controlling one of them with the hydraulic fluid discharged by the hydraulic cylinder controlling the other) thus allow total or partial balancing of the jib to be obtained at will.

It will be noted that the balancing device of the invention may be applied not only to jibs with articulated arms but also to jibs with telescopic arms.

DESCRIPTION OF THE DRAWINGS

For a better understanding of the device of the invention, two preferred embodiments will be described hereafter, by way of non limiting examples, with reference to the accompanying schematic drawings in which.

DESCRIPTION OF THE PREFERRED EMBODIMENTS

Figure 1:
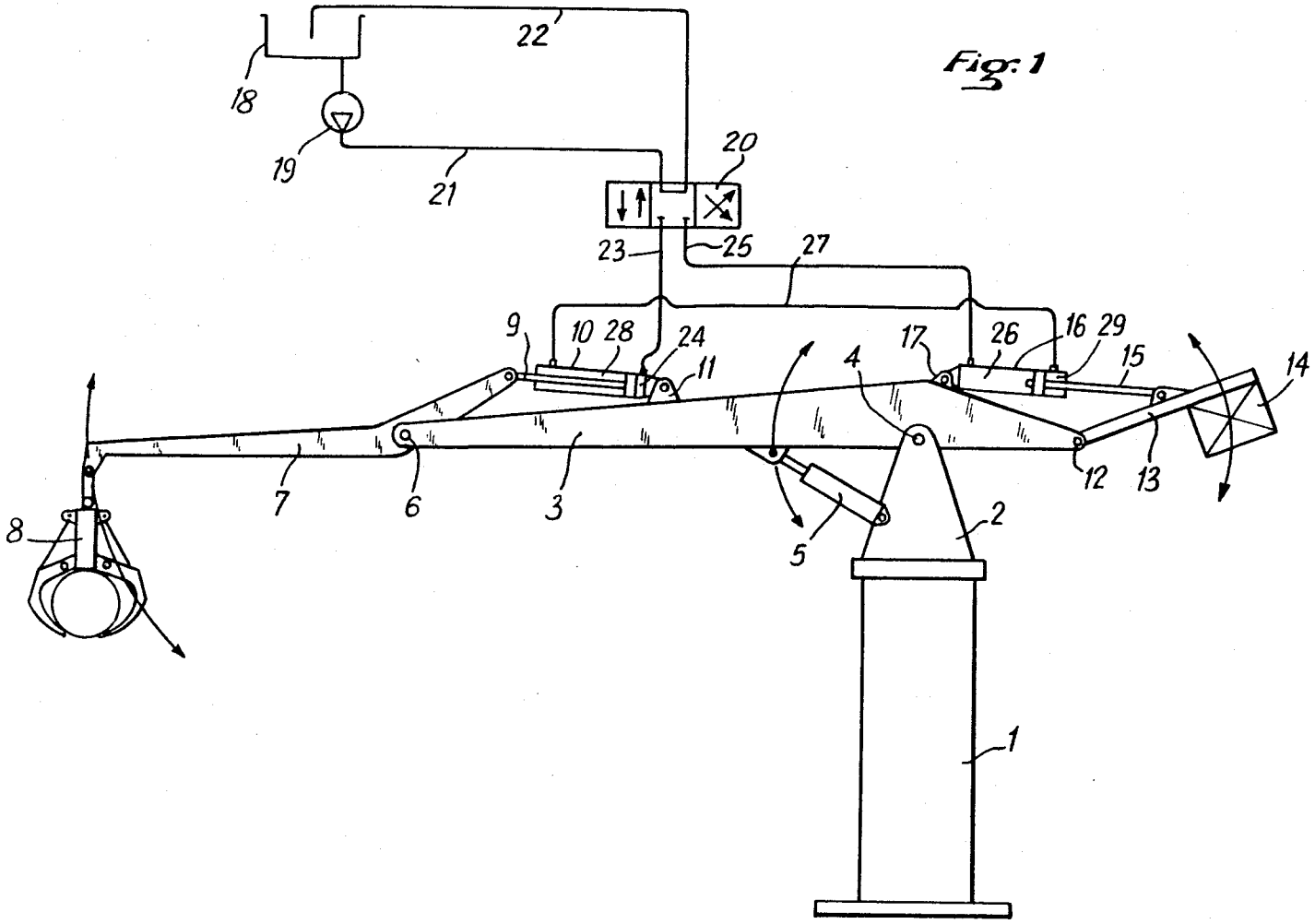
FIG. 1 is a side view of a crane jib with articulated arms, equipped with the automatic balancing device of the invention.

Referring to FIG. 1, there is shown at 1 the crane base, at 2 the pivoting turret mounted on this base and at 3 the main jib arm articulated at its rear end to turret 2, about a horizontal axis 4, for pivoting in a vertical plane under the control of a hydraulic cylinder 5. At the front end of the main arm 3 is articulated, about a horizontal axis 6, an auxiliary arm 7 whose front end supports a grasping means formed, in the example shown, by a grab 8. The rear bent end of the auxiliary arm 7 is integral with the free end of rod 9 of a hydraulic cylinder 10 whose body is articulated to a bracket 11 integral with the main arm 3.

At the rear end of the main arm 3 is articulated, about a horizontal axis 12, a balance-beam 13 integral with a counterweight 14. The balance-beam 13 is articulated to one end of the rod 15 of a hydraulic cylinder 16 whose body is pivotably fixed to a bracket 17 borne by the main arm 3.

The hydraulic supply system for cylinders 10 and 16 will now be described. For this, there is shown at 18 a reservoir of hydraulic fluid, at 19 a pump connected to this reservoir and at 20 a hydraulic three position valve. To this valve 20 are connected, on the one hand, a pressure duct 21 connected to pump 19 and a return duct 22 connected to the reservoir 18 and, on the other hand, a duct 23 connected to the full section chamber 24 of cylinder 10 and a duct 25 connected to the full section chamber 26 of cylinder 16. A duct 27 connects together in series the annular section chambers respectively 28 and 29 of cylinders 10 and 16. Valve 20 may occupy three different positions, namely:

- a central position (shown in the drawings) in which ducts 23 and 25, connected respectively to hydraulic cylinders 10 and 16, are isolated from the fluid supply and from the reservoir;
- a position corresponding to the left-hand part (looking at the figure) of the valve, in which duct 23 leading to chamber 24 of cylinder 10 is connected to pump 19 and duct 25 leading to chamber 26 of cylinder 16 is connected to the reservoir 18;
- a position corresponding to the right-hand part of the valve (looking at the figure) in which, conversely, the chamber 24 of hydraulic cylinder 10 is connected to the reservoir 18 and the chamber 26 of hydraulic cylinder 16 is connected to the supply pump 19.

The operation of the device will now be explained. Assuming that it is desired to extend the reach of the jib, the operator then places the valve 20 in the position corresponding to its right-hand part looking at FIG. 1, so that chamber 26 of hydraulic cylinder 16 is supplied with pressurized fluid and, by movement of rod 15, causes simultaneously counterweight 14 to pivot and, because of the connection between the chambers 29 and 28 of cylinders 16 and 10, the auxiliary arm to be raised. Since the value of the counterweight 14 is calculated as a function of the proper weight of the parts of the jib and of the grab 8, and as a function of the lever arms, the jib is then permanently balanced (wholly or partially), on the assembly formed by base 1 and turret 2. When the desired extended position of the jib is reached, valve 20 is brought back to its intermediate position and the lifting and lowering operations of the load are then provided by the hydraulic cylinder 5.

Should, on the other hand, the operator decide to reduce the reach of the jib, he will then have to place valve 20 in the position corresponding to its left-hand part looking at FIG. 1. Chamber 24 of hydraulic cylinder 10 is then supplied, which causes the auxiliary arm to pivot and simultaneously, through the connection of chamber 28 of this cylinder with chamber 29 of the hydraulic cylinder 16, counterweight 14 to be raised to ensure automatic balancing.

Figure 2:
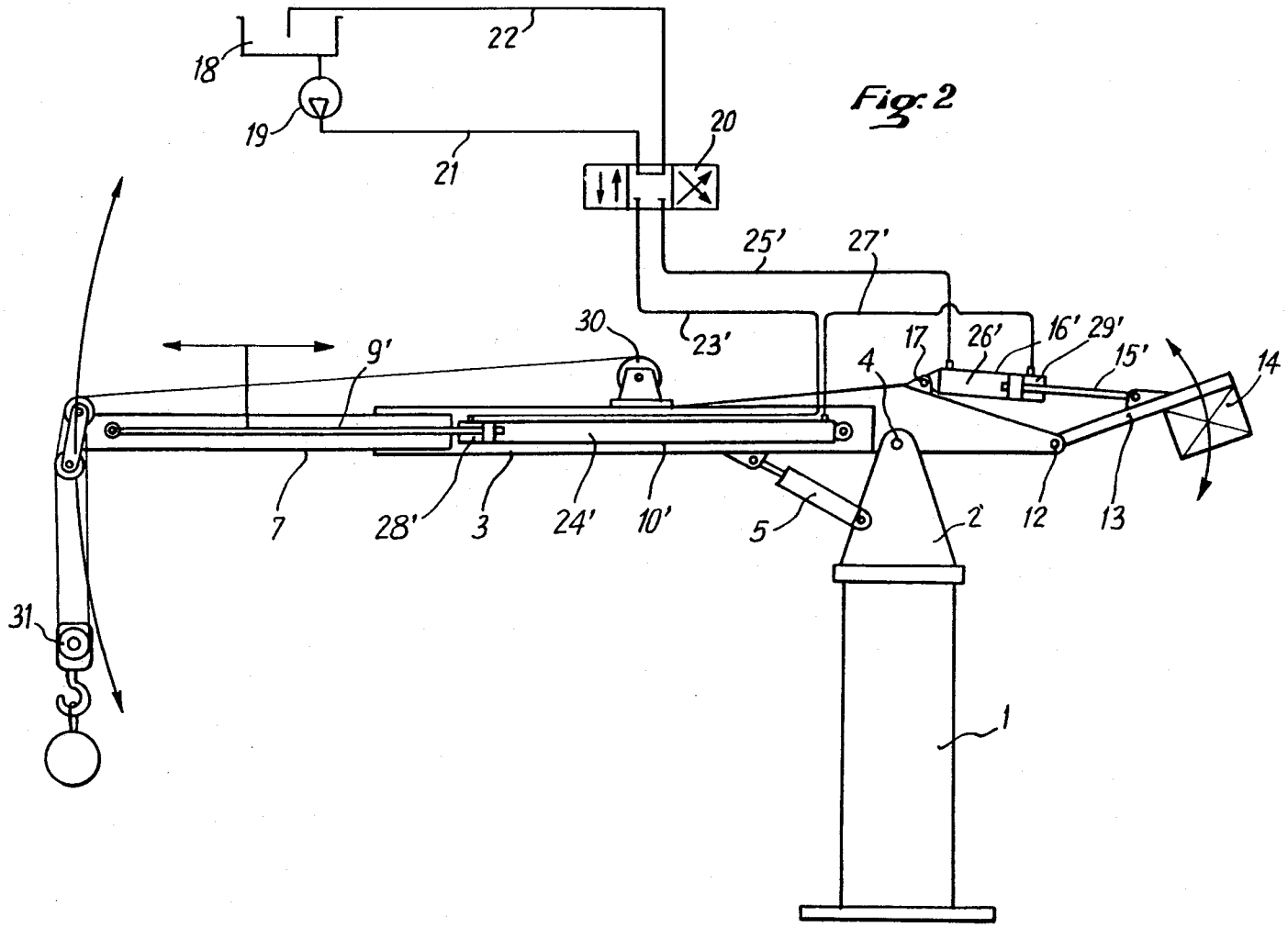
FIG. 2 is a similar view for a crane jib with telescopic arms.

The embodiment of FIG. 2 only differs in the main from that of FIG. 1 because of the fact that the auxiliary arm 7 is mounted for telescopic sliding inside the main arm 3, under the action of hydraulic cylinder 10'. The grab 8 of FIG. 1 may also be replaced by a system with winch 30 and sheave-block 31. The hydraulic control device is practically the same as that of FIG. 1, except that duct 23' connects valve 20 to the annular section chamber 28' of the hydraulic cylinder 10', whereas duct 27' connects together in series the full section chamber 24' of hydraulic cylinder 10' and the annular section chamber 29' of the hydraulic cylinder 16'. Similarly, to increase the reach of the jib, the user will place valve 20 in its position corresponding to its right-hand part looking at FIG. 2, which will cause simultaneously the counterweight 14 to pivot and the auxiliary telescopic arm 7 to extend while providing automatic balancing. Conversely, to reduce the reach of the jib, the user will place valve 20 in its position corresponding to its left-hand part looking at FIG. 2, providing simultaneously retraction of the auxiliary arm 7 and raising of the counterweight 14.

It will be readily understood that the above description has only been given by way of example, without any limiting character, and that constructional additions or modifications could be made without departing from the scope and spirit of the invention defined by the following claims.

What I claim is:

1. A variable reach crane jib which comprises:

(a) a main arm mounted for pivoting on a supporting turret, (b) an auxiliary arm extending the main arm at one end thereof and movable with respect to said main arm to vary the reach of the jib, said auxiliary arm adapted to support a load at its forward end, (c) a first hydraulic cylinder disposed between said main arm and said auxiliary arm for controlling the position of said auxiliary arm with respect to said main arm, (d) a balance beam pivoted at the other end of said main arm and having no mechanical connection with said auxiliary arm other than through said main arm, (e) a counterweight supported on said balance beam for balancing the jib, (f) a second hydraulic cylinder disposed between said main arm and said balance beam for controlling the position of said balance beam with respect to said main arm, and (g) control means selectively connecting one of the chambers of said first hydraulic cylinder to a source of hydraulic fluid under pressure or to a fluid discharge means while connecting one of the chambers of said second hydraulic cylinder to said fluid discharge means or to said source of hydraulic fluid pressure, respectively, and further including conduit means forming a closed-circuit path connecting the other chamber of said first hydraulic cylinder to the other chamber of said second hydraulic cylinder so as to define a permanently balanced jib in the unloaded condition and a partially balanced jib in the loaded condition wherein the counterweight and closed fluid path assist in lifting the load.

2. The crane jib as claimed in claim 1 wherein the auxiliary arm is articulated to the main arm.

3. The crane jib as claimed in claim 1 wherein the auxiliary arm is mounted telescopically slidable inside the main arm.

4. The crane jib according to claim 1, further comprising a third hydraulic cylinder disposed between said main arm and said supporting turret for controlling the position of said main arm with respect to said supporting turret for lifting and lowering a load supported by said auxiliary arm, substantially independently of said first and second hydraulic cylinders, the energy consumption of said third hydraulic cylinder being substantially reduced in response to the balancing action of said counterweight.

5. The crane jib according to claim 1, wherein said control means comprises a hydraulic valve having a first position connecting said first chamber of said first hydraulic cylinder to a source of hydraulic fluid under pressure and connecting said first chamber of said second hydraulic cylinder to a fluid discharge means, and said valve having a second position connecting said first chamber of said first hydraulic cylinder to said fluid discharge means and said first chamber of said second hydraulic cylinder to said source of hydraulic fluid under pressure.

6. A variable reach crane jib which comprises:

(a) a main arm mounted for pivoting on a supporting turret, (b) an auxiliary arm extending said main arm at one end thereof and movable with respect to said main arm to vary the reach of the jib said auxiliary arm adapted to support a load at its forward end, (c) a first hydraulic cylinder disposed between said main arm and said auxiliary arm for controlling the position of said auxiliary arm with respect to said main arm, (d) a balance beam pivoted at the other end of said main arm and having no mechanical connection with said auxiliary arm other than through said main arm, (e) a counterweight supported on said balance beam for balancing the jib, (f) a second hydraulic cylinder disposed between said main arm and said balance beam for controlling the position of said balance beam with respect to said main arm, and (g) control means including a distributor means and a fluid conduit means, each of said hydraulic cylinders including a piston forming a first and second chamber therein, said distributor means selectively connecting said first chamber of said first hydraulic cylinder to a source of hydraulic fluid under pressure or to a fluid discharge means while connecting said first chamber of said second hydraulic cylinder to a fluid discharge means or to a source of hydraulic fluid under pressure, respectively, said conduit means forming a closed fluid path connecting said second chamber of said first hydraulic cylinder and said second chamber of said second hydraulic cylinder, so that fluid discharged from said second chamber of said first hydraulic cylinder in response to movement of said piston of said first hydraulic cylinder in direction to reduce the size of said second chamber thereof, flows through said conduit means into said second chamber of said second hydraulic cylinder to cause a proportional movement of said piston of said second hydraulic cylinder in direction to increase the size of said second chamber of said second hydraulic cylinder for moving said balance beam to change the position of said counterweight in proportion to the movement of said auxiliary arm, selectively connecting one of the chambers of said first hydraulic cylinder to a source of hydraulic fluid under pressure or to a fluid discharge means while connecting one of the chambers of said second hydraulic cylinder to said fluid discharge means or to said source of hydraulic fluid pressure, respectively, and further including conduit means forming a closed-circuit path connecting the other chamber of said first hydraulic cylinder to the other chamber of said second hydraulic cylinder so as to define a permanently balanced jib in the unloaded condition and a partially balanced jib in the loaded condition wherein the counterweight and closed fluid path assist in lifting the load.

* * * * *

UNITED STATES PATENT AND TRADEMARK OFFICE

CERTIFICATE OF CORRECTION

PATENT NO. : 4,867,321

DATED : Sep. 19, 1989

INVENTOR(S) : Serge Montgon

It is certified that error appears in the above-identified patent and that said Letters Patent is hereby corrected as shown below:

On the cover page, correct the name of the Assignee to read:

Société Montgon Systèmes,

Signed and Sealed this

Twenty-seventh Day of November, 1990

*Attest:*

HARRY F. MANBECK, JR.

*Attesting Officer*

*Commissioner of Patents and Trademarks*